US009196445B2

(12) United States Patent
Douglass

(10) Patent No.: US 9,196,445 B2
(45) Date of Patent: Nov. 24, 2015

(54) ELECTRIC FUSE WITH TORQUE RESTRICTING TERMINALS

(75) Inventor: Robert Stephen Douglass, Wildwood, MO (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 271 days.

(21) Appl. No.: 13/176,478

(22) Filed: Jul. 5, 2011

(65) Prior Publication Data

US 2013/0009744 A1 Jan. 10, 2013

(51) Int. Cl.

| | |
|---|---|
| ***H01H 85/20*** | (2006.01) |
| ***H01H 85/00*** | (2006.01) |
| ***H01H 85/15*** | (2006.01) |
| *H01H 85/10* | (2006.01) |

(52) U.S. Cl.

CPC ..... *H01H 85/0013* (2013.01); *H01H 85/15* (2013.01); *H01H 85/10* (2013.01)

(58) Field of Classification Search

CPC .... H01H 85/0013; H01H 85/15; H01H 85/10
USPC ..... 337/187, 186, 191, 192–194, 251–254, 337/159, 290
See application file for complete search history.

(56) References Cited

U.S. PATENT DOCUMENTS

| | | | | | |
|---|---|---|---|---|---|
| 2,794,097 | A * | 5/1957 | Jacobs, Jr. | 337/278 |
| 3,654,696 | A * | 4/1972 | Wechsler et al. | 29/623 |
| 4,101,860 | A * | 7/1978 | Fister | 337/159 |
| 4,260,215 | A * | 4/1981 | Gross et al. | 439/698 |
| 4,320,376 | A * | 3/1982 | Panaro et al. | 337/252 |
| 4,972,170 | A * | 11/1990 | Ehlmann et al. | 337/228 |
| 5,229,739 | A * | 7/1993 | Oh et al. | 337/290 |
| 5,736,918 | A * | 4/1998 | Douglass | 337/186 |
| 5,854,583 | A * | 12/1998 | Falchetti | 337/290 |
| 5,929,739 | A * | 7/1999 | Totsuka | 337/198 |
| 6,157,287 | A | 12/2000 | Douglass et al. | |
| 6,275,135 | B1 * | 8/2001 | Hibayashi et al. | 337/227 |
| 7,659,804 | B2 * | 2/2010 | Harris et al. | 337/159 |
| 7,808,362 | B2 * | 10/2010 | Stanek et al. | 337/187 |
| 2004/0085179 | A1 * | 5/2004 | Ackermann | 337/159 |
| 2006/0055497 | A1 * | 3/2006 | Harris et al. | 337/14 |
| 2009/0309689 | A1 * | 12/2009 | Pavlovic et al. | 337/187 |
| 2010/0194519 | A1 * | 8/2010 | Harris et al. | 337/227 |

* cited by examiner

*Primary Examiner* — Anatoly Vortman
(74) *Attorney, Agent, or Firm* — Armstrong Teasdale LLP

(57) ABSTRACT

Electrical fuses include slip fit terminal elements coupled to the ends of a fuse element. The terminal elements may rotate relative to the fuse element ends as the fuses are bolted to circuit conductors and protect the fuse element from being damaged.

35 Claims, 6 Drawing Sheets

STATE OF THE ART

ELECTRIC FUSE WITH TORQUE RESTRICTING TERMINALS

BACKGROUND OF THE INVENTION

The field of the invention relates generally to electrical fuses, and more specifically to electrical fuses having terminals that are bolted to electrical circuit conductors.

Fuses are overcurrent protection devices for electrical circuitry, and are widely used to protect electrical power systems and prevent damage to circuitry and associated components when specified circuit conditions occur. A fusible element or assembly is coupled between terminal elements of the fuse, and when specified current conditions occur, the fusible element or assembly, disintegrates, melts or otherwise structurally fails and opens a current path between the fuse terminals. Line side circuitry may therefore be electrically isolated from load side circuitry through the fuse, preventing possible damage to load side circuitry from overcurrent conditions. In view of constantly expanding variations of electrical power systems, improvements in electrical fuses are desired.

Recent advancements in electrical vehicle technologies, among other things, has presented unique challenges to fuse manufacturers. In particular, electrical power systems for conventional, internal combustion engine-powered vehicles operate at relatively small voltages, typically at or below about 48 VDC. Electrical power systems for state of the art electric powered vehicles, however, operate at much higher voltages. Electrical power systems for some electric powered vehicles may operate at voltages as high as 450 VDC or more. Operating conditions of electrical fuses in such higher voltage power systems is much more severe than lower voltage fuses commonly used in conventional, lower voltage vehicle systems. Specifically, specifications relating to electrical arcing conditions as the fuse opens can be particularly difficult to meet for higher voltage power systems, especially when coupled with an industry preference for reduction in the size of electrical fuses. Providing relatively small fuses that can capably handle high current and high battery voltages, while providing acceptable interruption performance as the fuse element operates is challenging, to say the least.

Further challenges to fuse manufactures arise from the manner of connection of the fuses to the electrical power system of an electric vehicle. For such applications, the electrical fuses are preferably bolted directly to circuit conductors in the power system. This connection method provides the best condition for any heating of the fuse in operation to be liberated into the circuit conductors and connectors. However, the bolting of the fuse directly to the circuit conductors can pose mechanical damage to the fragile features of the fuse element. Specifically, bolt torque as the fuse is mechanically connected to the circuit conductors can damage, the fragile, current-limiting features of the fuse element at a location internal to the fuse. As such damage that may occur can be difficult to predict or detect from the perspective of an installer or person servicing the electrical power system in use.

FIG. 11 illustrates an exemplary fuse element 100 capable of satisfactorily operating at higher voltages of, for example, an electrical power system associated with an electric powered vehicle. The fuse element 100 is fabricated from a generally elongated conductor body 102 having opposite ends 104 and 106. The ends 104 and 106 in the exemplary embodiment shown are generally planar elements that define connection tabs extending longitudinally from either side of a fuse element portion 108.

As shown in the example of FIG. 11, the fuse element portion 108 include a number of openings 110 formed therethrough that define current-limiting areas of reduced cross sectional area, sometimes referred to as weak spots. The number and arrangement of the weak spots may be varied in other embodiments, but are strategically selected such that the fuse element portion 110 melts, disintegrates, breaks or otherwise structurally fails when electrical current flowing through the fuse element portion 108 reaches a predetermined limit. This is referred to an "opening" of the fuse because the conductive path through the fuse element portion 110 can no longer conduct current and an open circuit condition results.

By strategically selecting the number, dimensions, and relative spacing of the openings 110 defining reduced cross sectional areas, the fuse element can reliably open in response to a specified current condition (e.g., an overcurrent condition) at one or more locations in the fuse element portion 108, typically at one or more locations adjacent to the weak spots. The weak spot openings 110 therefore affect not only the amount of current that the fuse element portion 108 can withstand, but to a large extent determine the most likely location(s) that the fuse element portion 108 will actually open in response to current conditions. While an exemplary arrangement of weak spot openings 110 is shown, other arrangements are, of course possible.

The fuse element 100 may be fabricated from a substantially planar strip of conductive material according to known techniques. Additionally, and as shown in FIG. 11, the fuse element portion 108 may be formed with a first edge 112 that is bent out of the plane of the conductive body 102. In the exemplary embodiment illustrated, the first edge 112 extends substantially perpendicularly or normal to the plane of the conductor body 102, and extends in first direction shown in FIG. 11 as an upward direction. The fuse element portion 108 may likewise be formed with a second edge 114 that is also bent out of the plane of the conductive body 102. In the exemplary embodiment illustrated, the second edge 114 extends substantially perpendicularly or normal to the plane of the conductor body 102, and extends in second direction shown in FIG. 11 as a downward direction. As such, the edges 112, 114 extend in opposite directions from one another. The formed edges 112, 114 increase the capacity of the fuse element 100 while reducing its size measured from lateral edge 112 to lateral edge 114. Other geometric variations of the fuse element portion 108 are, of course, possible with similar effect to increase the capacity of the fuse element while still providing a relatively compact size that facilitates a reduction in the size of the fuse. Alternatively, however, in another embodiment the fuse element portions 108 may be entirely planar if desired.

It is also seen that some of the weak spot openings 110 reside in part on the planar surface of the conductive body 102 and in part on the respective out of plane edges 112, 114. That is, the out of plane edges 112, 114 are also provided with weak spot openings 110. The weak spot openings in the edges 112, 114 shown are a continuation of the pattern provided on the planar surface of the conductive body 102. This need not be the case in other embodiments, however. The side edges 112, 114 need not include weak spot openings at all, or could include weak spot openings that are differently arranged from those in the main, planar surface of the conductive body 102.

Further features may provided in the fuse element portion 108 as desired. For example, time delay features, m-spot features, and other features familiar to those in the art may be provided to enhance the interruption characteristics as the fuse element 100 opens in response to selected circuit conditions. The current capacity of the fuse element 100 is determined principally by the thickness of the conductor body 102 used to fabricate the fuse element 100, the number and arrangement of the weak spot openings 110, and the dimensions of the formed edges 112 and 114. The embodiment of the fuse element 100 shown in FIG. 11 is suitable for use with an electrical power system for an electric powered vehicle operating at, for example, a voltage of about 450 VDC, and can easily withstand relatively high electrical current associated therewith while reliably providing desirable opening characteristics, in response to overcurrent conditions, to isolate load side circuitry 126 and associated power-receiving devices from the line side circuitry 124 and power supply devices.

The ends 104 and 106 of the fuse element 100, extend in the plane of the conductor body 102 and define connection tabs attachable to respective circuit conductors 116, 118 via fasteners such as bolts 120, 122. The conductor 116 may extend to and establish electrical connection with the line side power supply or circuitry 124, and the conductor 118 may extend to and establish electrical connection with the load side power receiving device or circuitry 126. Thus, when so installed, electrical current flows from the line side circuitry 124 to and through the circuit conductor 116, from the conductor 116 to and through the fuse element 100, and from the fuse element 100 to and through the conductor 118 to the load side circuitry 126. While in the example shown, the conductors 116 and 118 are shown as flat conductor bars, a variety of alternative conductors and connectors are possible to make the line and load side electrical connections. Additionally, either of the circuit conductors 116, 118 may be configured as a bus bar and receive electrical power from multiple sources (e.g. multiple batteries of the vehicle), or supply electrical power to multiple loads. In such an embodiment, a single fuse element 100 may provide fusible circuit protection to multiple loads and/or may supply power to a load or loads from more than one power supply source such as multiple storage batteries in an electrical vehicle power system.

As the bolts 120, 122 are tightened to mechanically attach the fuse element ends 104, 106 to the circuit conductors 116, 118, torque forces (indicated by the arrows F in FIG. 11) may be transmitted to the fuse element portion 108. Because of the numerous openings 110 creating the weak spots in the fuse element portion 108 at preferred locations, however, the fuse element portion 108 is a structurally fragile element compared to the fuse element ends 104 and 106. Consequently, even a relatively small torsional force F applied when the bolts 120 and/or 122 are tightened to mechanically connect the fuse element 100 to the circuit conductors 116, 118 can damage or impair the fuse element 100. Especially where the weak spot openings 110 are located, the fragile fuse element portion 108 is highly susceptible to twisting, deformation, and/or fracture that will alter its operating conditions and opening characteristics. Suboptimal fuse operation will result if such damage occurs, and in the unfortunate case wherein the fuse element portion 108 completely breaks so as to sever the conductive path through the fuse element 102 altogether, the fuse element 100 would be rendered completely inoperable.

A careful installer would perhaps be able to avoid damaging the fuse element 100 via limiting the amount of torque applied to the bolts 120, 122 as the electrical fuse is installed, but considering the potential number of different persons that may at some point install or remove a fuse in a vehicle (e.g., a manufacturer, a dealer, a service technician, and a vehicle owner all having varying amounts of training and experience) human error in advertently applying too much torque to the bolts 120, 122 seems to be inevitable across a large number of vehicles to be manufactured and periodically serviced and maintained.

Further, because the fuse element 100 is typically contained in a housing (not shown in FIG. 11), if the fuse element 100 is advertently damaged when the fuse is installed, or perhaps even removed, it is unlikely to be detected. Because fuses can be in service (i.e., connected to energized electrical circuitry) for indefinite and lengthy periods of time (e.g., years or even decades) before an overcurrent condition occurs that is sufficient to open the fuse, a suboptimal fuse can result in suboptimal circuit protection for an extended period of time. Considering the expense and sophistication of modern electric vehicles, and the many computerized controls, adequate circuit protection is paramount.

If nothing else, premature or unnecessary opening of fuses that are inadvertently damaged during installation would be an unwelcome nuisance to fuse manufacturers, vehicle manufacturers, dealers, service technicians and owners. Particularly for fuse and vehicle manufacturers, issues associated with inadvertently damaged fuses could be perceived as defects in the design and/or manufacture of the fuses or the vehicle, when in truth none exists. That is, consumer complaints may arise from perceived manufacturing issues of the fuses and/or the vehicle when instead the real problem lies, unbeknownst to the vehicle owner or those servicing the vehicle, with overly-tightened connections during installation of the fuse that, in turn, alter or affect the proper and reliable operation of the fuse as it was designed.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
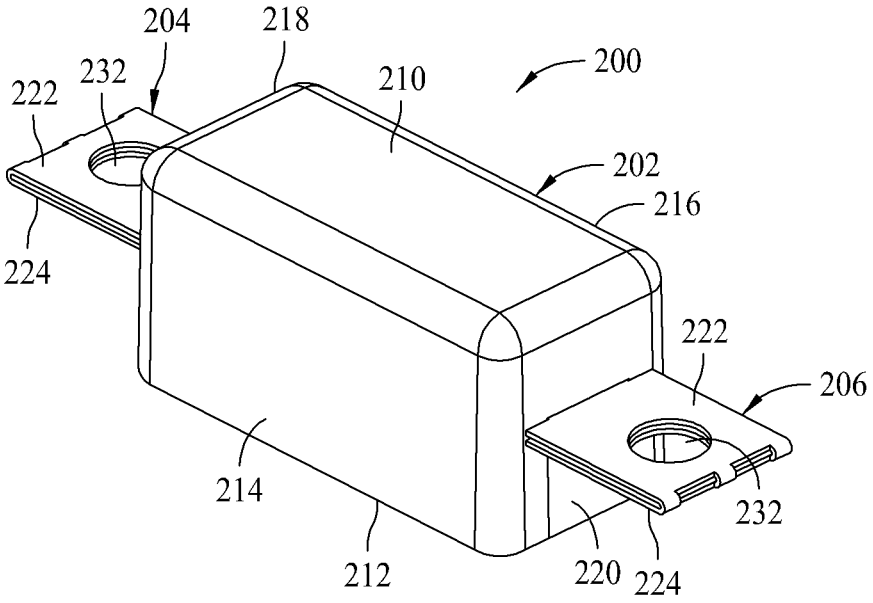
FIG. 1 is a perspective view of an exemplary embodiment of an electrical fuse.
Figure 2:
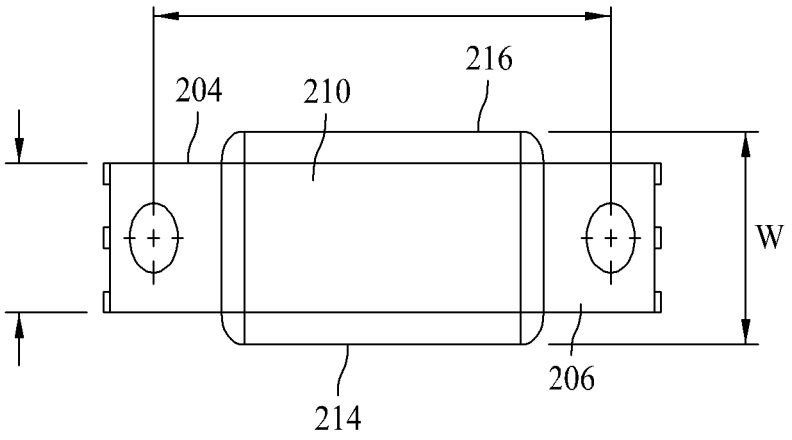
FIG. 2 is a top view of the exemplary electrical fuse shown in FIG. 1.
Figure 3:
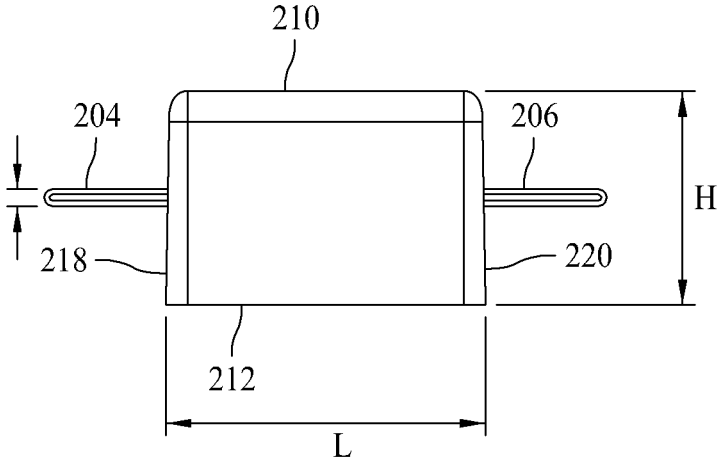
FIG. 3 is a side elevational view of the exemplary electrical fuse shown in FIGS. 1 and 2.
Figure 4:
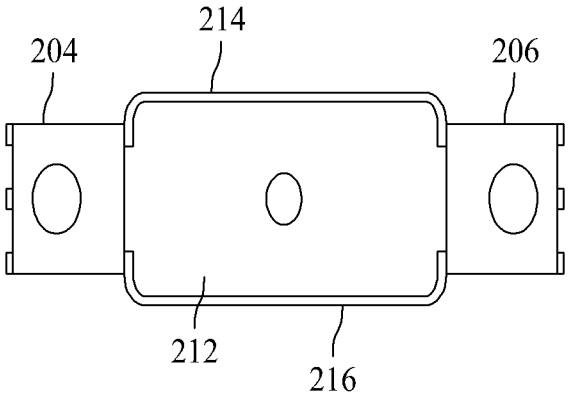
FIG. 4 is a bottom view of the exemplary electrical fuse shown in FIGS. 1-3.

Exemplary embodiments of electrical fuses are disclosed hereinbelow that overcome numerous difficulties and disadvantages in the art, including but not necessarily limited to those discussed above, as well as related methods that overcome difficulties and drawbacks of the state of the art. Method aspects will be in part inherent and in part explicit discussed in the following description.

Specifically, FIGS. 1-10 illustrate exemplary embodiments of an electrical fuse assembly that overcome torque related problems as discussed above when connecting the fuse to circuit conductors with fasteners such as bolts. As explained in detail below, this is achieved with terminal elements, separately provided from the fuse element, that are movable relative to the ends of the fuse element, and therefore restrict, if not eliminate, torsional forces from reaching the delicate fuse element portion that is vulnerable to damage. While the present discussion is made in the context of high voltage electrical power systems for vehicles, it is recognized that the inventive concepts described below may accrue to other end use applications. The benefits of the invention generally accrue to any type of fuse or fuse application that is bolted to circuit conductors, and the electric powered vehicle environment is one such example that is described for the sake of illustration rather than limitation.

FIGS. 1-10 illustrate various views of an exemplary embodiment of an electrical fuse 200 including a housing 202 and terminal elements 204, 206 projecting from the housing 200 for bolted connection to circuit conductors such as the conductors 116, 118 described above in relation to FIG. 11. The terminal elements 204, 206 in the exemplary embodiments shown, are coupled to the fuse element connection tabs 104, 106 (FIGS. 5 and 8-10) and thus provide electrical connections to the fuse element 100 and the fuse element portion 108 thereof when the bolts 120, 122 are tightened to clamp the terminal elements 204, 206 to the circuit conductors 116, 118.

Figure 5:
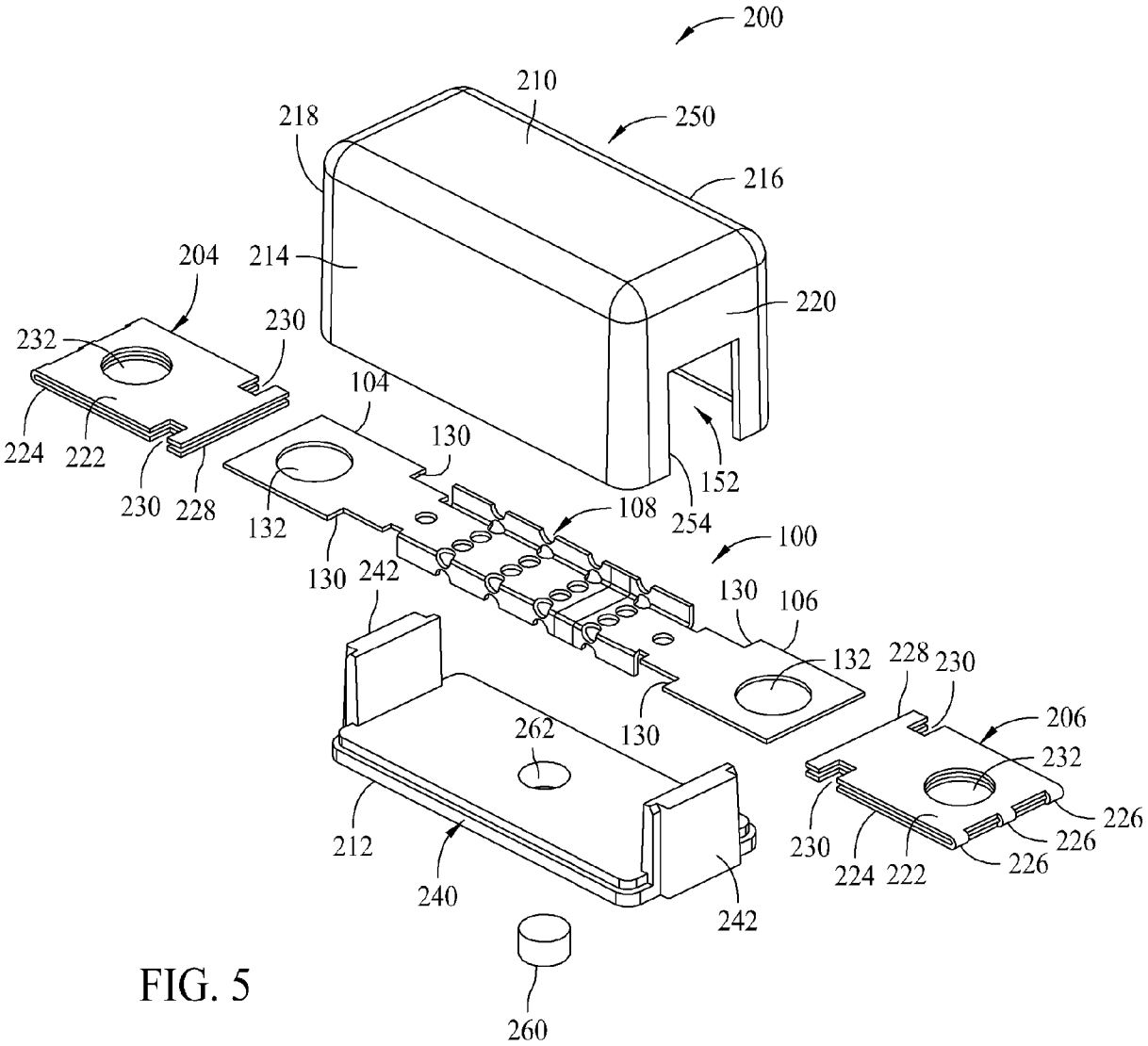
FIG. 5 is an exploded view of the electrical fuse shown in FIG. 1.
Figure 6:
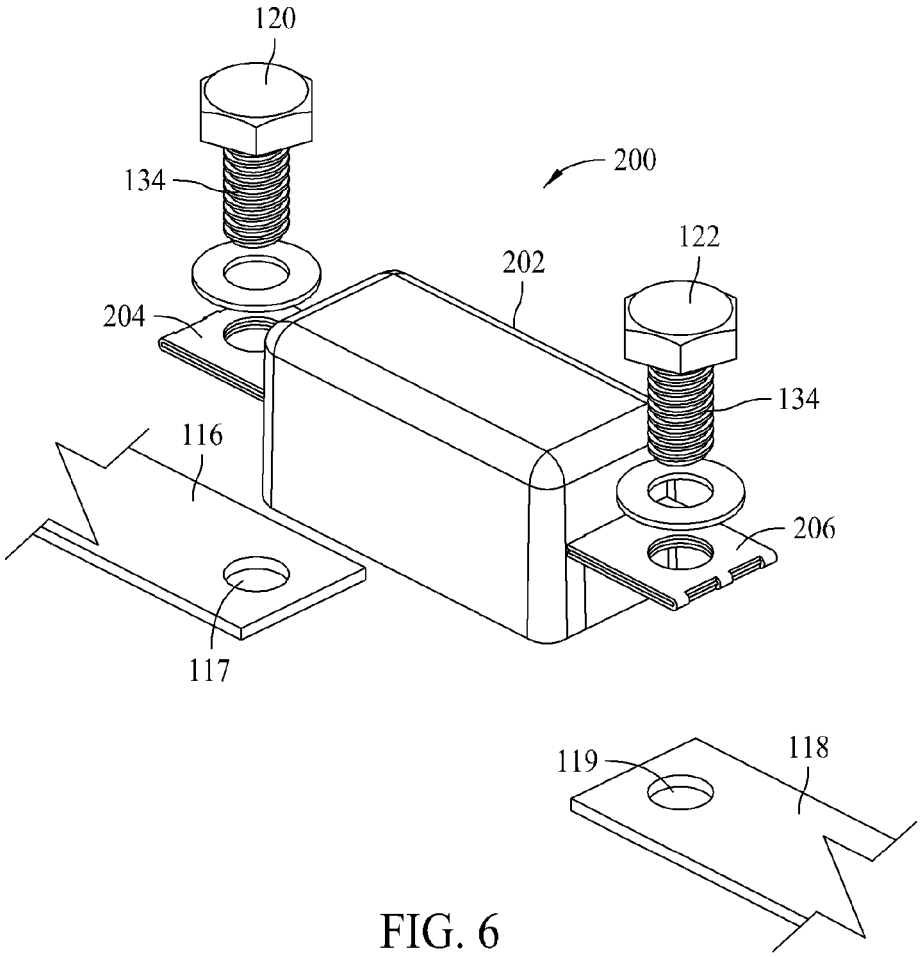
FIG. 6 illustrates the electrical fuse shown in FIG. 1 being installed to circuit conductors with bolted connections.

FIGS. 1-4 illustrate the electrical fuse 200 apart from the circuit conductors 116 and 118, while FIG. 5 illustrates the electrical fuse 200 in exploded view. Meanwhile, FIGS. 6-10 illustrate various aspects of connecting the fuse 200 to the circuit conductors 116, 118.

Turning first to FIGS. 1-4, the fuse housing 202 is fabricated from a generally insulating or nonconductive material, such as heavy duty plastic according to known techniques or another suitable material known in the art. The housing 202 is formed into a generally rectangular shape as shown, and includes a top wall 210, a bottom wall 212 opposite the top wall 210, side walls 214 and 216 interconnecting the bottom and top walls 210, and end walls 218, 220 interconnecting the top and bottom walls 210 and 212 and also the side walls 214 and 216. The housing 102 therefore defines a box-like enclosure for the fuse element 100 as seen in FIG. 5.

The exemplary housing 202 shown in FIGS. 1-4 is relatively compact in size, and has a length L (FIG. 3) of about 1.65 inches (42.01 mm), a width W (FIG. 2) of about 0.79 inches (20 mm) and a height H (FIG. 3) of about 0.79 inches (20 mm). As such, the fuse housing 202 advantageously provides a compact package size, and is noticeably smaller than conventional, high voltage fuses that are similarly bolted in place with respect to electrical conductors. It is contemplated, however, that the dimensions of the fuse 200 may be varied for different purposes and as desired. Additionally, while the height H and width W of the housing 202 in the example shown in the Figures is the same, these dimensions need not be the same in other embodiments. For that matter, the housing 202 need not be rectangular in other embodiments. Similar benefits to those described herein can be achieved with non-rectangular housings, included but not limited to cylindrical housings.

The terminal elements 204 and 206, as best seen in FIG. 5, are generally planar conductive elements formed as sleeves that slip over the fuse element ends 104, 106. That is, in an exemplary embodiment, the terminal elements 204, 206 may be formed from a conductive strip of material that is folded upon itself to form a sleeve that accepts the respective ends 104, 106 of the fuse element 100 as best shown in FIG. 5. The terminal elements 204, 206 each accordingly have an upper side 222 and a lower side 224 joined with hinge like connecting sections 226. The upper and lower sides 222, 224 are spaced apart by an amount slightly greater than the thickness of the fuse element ends 104, 106 such that the terminal elements 204, 206 may be slipped over the ends 104, 106 of the fuse element 100 with a leading end 228 receiving the fuse element ends 104, 106. As such, the upper side 222 overlies an upper surface of the respective fuse element end, and the lower side 224 underlies the lower surface of the respective fuse element end. That is, each fuse element end 104, 106 is sandwiched between the upper side 222 and the lower side 224 of each terminal element 204, 206.

The terminal elements 204, 206, as shown in FIG. 5, are substantially identically constructed but are reversed in a mirror-image arrangement on the fuse element ends 104, 106. Each terminal element 204, 206 includes a pair of notches 230 formed adjacent the leading end 228, and a fastener opening or through hole 232 extending completely therethrough. When assembled as shown in FIGS. 1-4 and 6-10, the notches 230 generally align with shoulders 130 (FIG. 5) formed in the fuse element ends 104, 106. Additionally, the through hole 232 of each terminal element 204, 206 is aligned with and substantially coincides with a complementary opening or though hole 132 in each end 104, 106 of the fuse element 100.

When the through holes 132, 232 are aligned in the assembly, they collectively receive a shank 134 (FIGS. 6-10) of one to the bolts 120, 122 as the electrical fuse 100 is installed to the circuit conductor 116, 118. Because the terminal elements 204, 206 are only slip-fit to the fuse element ends 104, 106 they are movable relative to the terminal ends 204, and 206. That is, the terminal elements 204, 206 are not fixedly mounted to the fuse elements 104, 106 via soldering, brazing, welding or other techniques commonly used in electrical fuse constructions to connect the fuse element to connecting terminal structure.

The terminal elements 204, 206 as best shown in FIGS. 1, 3 and 5-10 project outwardly form the fuse housing 202 at locations spaced from the top wall 210 and the bottom wall 212 of the housing 202. In the example, shown, the terminal elements 204, 206 are spaced approximately equidistantly from the top and bottom walls 210, 212. As such, when the fuse 200 is mounted to the circuit conductors 116, 118 (FIGS. 7 and 10) a portion of the housing 202 extends above the conductors 116, 118 and a portion of the housing 202 extends below the conductors 116, 118. A relatively compact mounting arrangement results, although this may be considered optional in some embodiments. That is, the terminal elements 206 may be located in other locations in further and/or alternative embodiments.

FIG. 5 shows additional details of the housing 202 in an exemplary embodiment. In the example shown, the housing 202 may be fabricated from two parts, namely a base 240 and a cover 250. The base 240 may define the generally planar bottom wall 212, and end walls 242 may project upwardly from the bottom walls 212. The cover 250 is formed with the top wall 210, the side walls 214 and 216, and the end walls 218 and 220. The walls 210, 214, 216, 218 and 220 define a hollow, box like interior enclosure 152 that surround and protect the fuse element portion 108. The ends walls 218, 220 of the cover 250 include cut outs or openings 254 that receive the end walls 242 of the base 240.

As the fuse 200 is assembled, the terminal elements 204, 206 are coupled to the fuse element ends 104, 106. The fuse element 100 including the terminal elements 204, 206 is then placed to extend over the end walls 242 of the base 240 with the notches 230 aligned with the base end walls 242. The cover 250 is then placed over the fuse element 200, and the edges of the opening 254 in the cover 250 extend into the notches and capture the terminal elements 204 in place longitudinally. The cover openings 254 are dimensioned to receive the end walls 242 of the base and provide a closed, sealed enclosure around the fuse element portion 108 when the base 240 and cover 250 are joined. The openings 254, in combination with the notches 230 of the terminal elements 204, 206, creates a clearance that allows the terminal elements 204, 206 to move relative to respective fuse element ends 104, 106. More specifically, the terminal elements 204, 206 may rotate relative to the fuse element ends 104, 106 and also relative to the housing end walls 218, 220 and 242 as the fuse 200 is installed. The notches 230 and the edges of the housing openings 254, however, prevent the terminal elements 204, 206 from being removed from the housing 200.

As also shown in FIG. 5, the base 240 is formed with a through hole opening 262 that may be used to fill the housing enclosure 152 with an arc quenching media such as silica sand. A plug 260 may be provided to plug and seal the opening 262 when the arc quenching media has been introduced in a sufficient amount.

Figure 7:
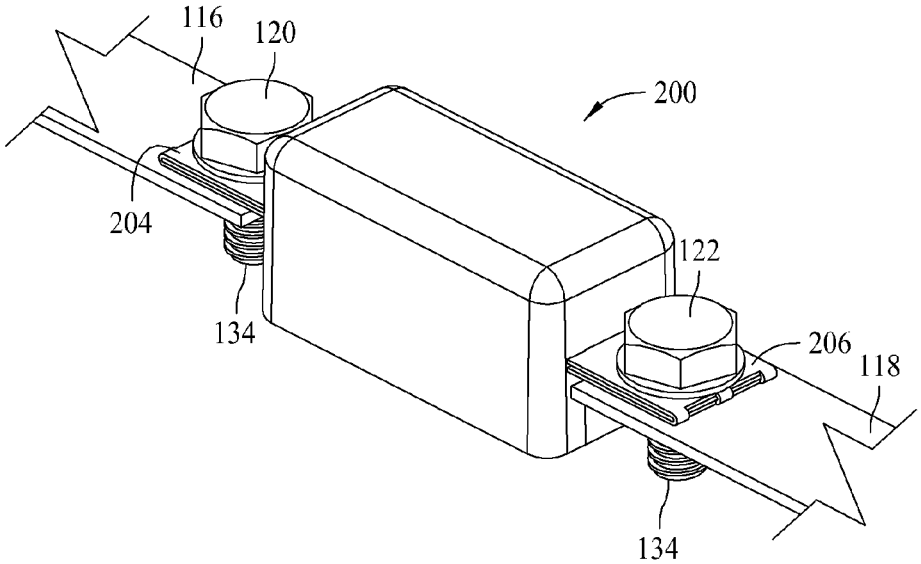
FIG. 7 shows the electrical fuse of FIG. 6 installed to the conductors.

In use, the assembled fuse 200 may be installed to the circuit conductors 116, 118 as shown in FIGS. 6-10. The through holes 232 of the terminal elements 204, 206 may be aligned with corresponding through holes 117, 119 in the circuit conductors 116, 118. The shanks 134 of the bolts 120, 122 may then be inserted through the holes 232 and 117, 119. An optional washer may be utilized to facilitate the connection as shown. When the bolts 120, 122 are inserted as shown in FIG. 7, a nut (not shown) may be applied to the shank 134 of each bolt 120, 122 to clamp the terminal elements 204, 206 to the conductor. Alternatively, the bolt shanks 134 may engage the chassis of an electrical powered vehicle, or other supporting structure, as the fuse 102 is mounted.

Figure 8:
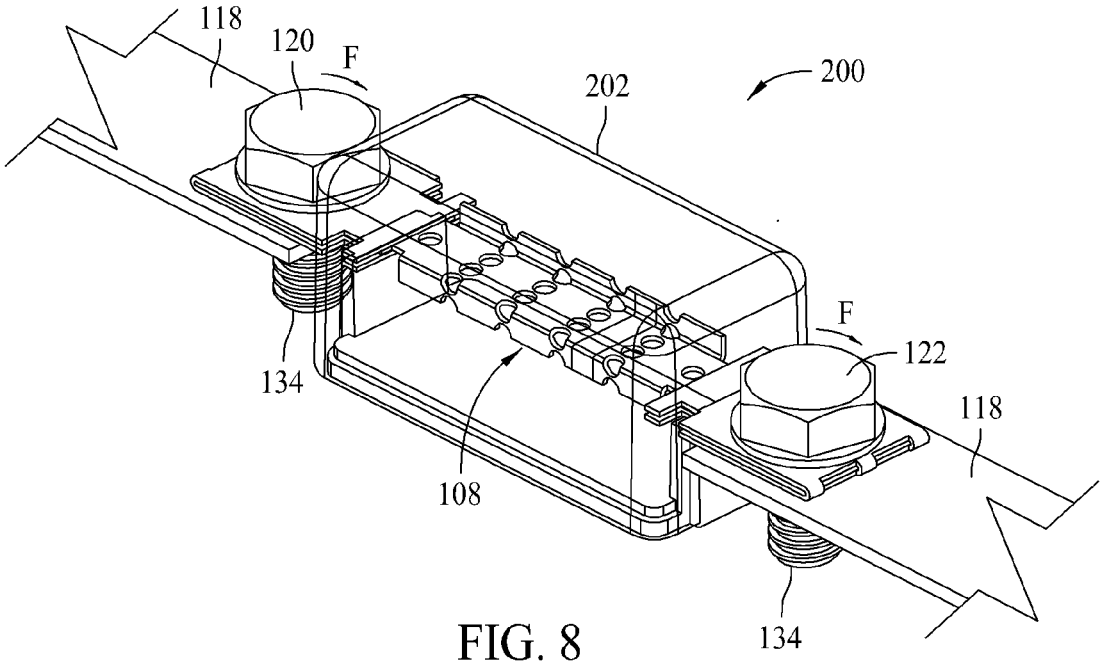
FIG. 8 illustrates the installed electrical fuse of FIG. 7 with internal components shown.
Figure 9:
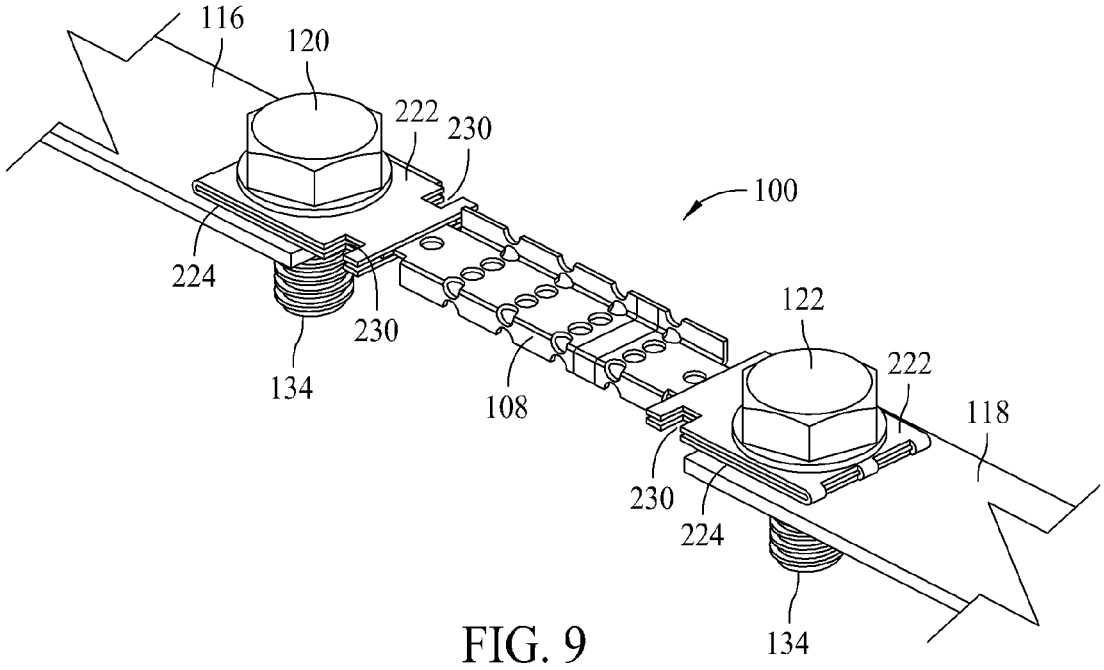
FIG. 9 illustrates a portion of the installed electrical fuse shown in FIG. 7.
Figure 10:
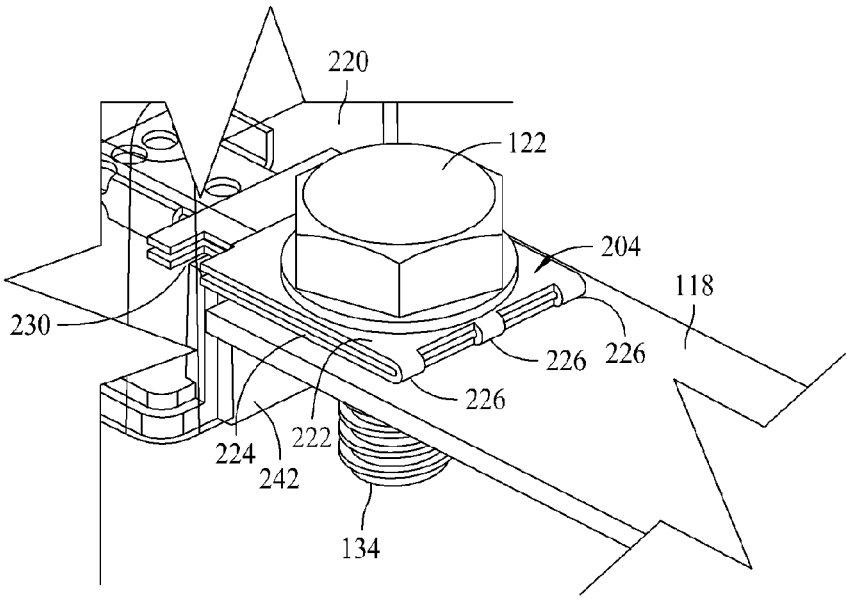
FIG. 10 is a magnified view of a portion of the electrical fuse shown in FIG. 7.
Figure 11:
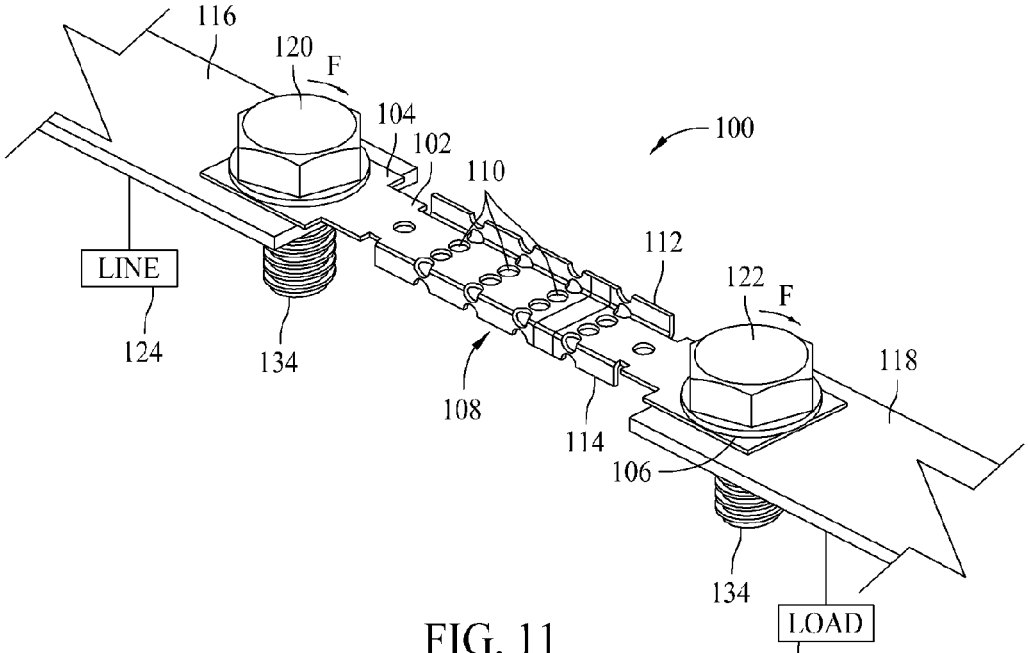
FIG. 11 illustrates a connection of a fuse element to circuit conductors.

As shown in FIGS. 8-10, as the bolts 120, 122 are tightened, torsional forces in the direction of arrow F may result on the terminal elements 204, 206. Because the terminal elements 204, 206 are free to move, however, the terminal elements 204, 206 may rotate in the direction of the force F when subjected to the force F because of the clearance created by the terminal element notches 230 and the openings 254 in the housing cover 250. Up to the limits of the clearance provided, the terminal elements 204, 206 greatly restrict a transmission of the forces F to the relatively delicate fuse element portion 108. Once the clearance is exhausted by the moving terminal elements 204, 206 as the bolts are tightened, any further application of the forces F on the terminal elements 204, 206 is generally applied to the housing 200 at the side edges of the cover openings 254, and is not transmitted to the fuse element portion 108 that is susceptible of being damaged. The structurally fragile fuse element portion 108 is largely mechanically isolated from the torque forces F and unlikely to be damaged because of the movable terminal elements 204, 206.

By applying two additional terminal elements 204, 206 that are free to move during the bolt down torque installation, the torque stresses are distributed more evenly during slippage between the terminal elements 204, 206 and the ends 104, 106 of the fuse element 100. The slip fit of the terminal elements 204 and 206 over the fuse element ends 104, 106 effectively acts as a washer to distribute the load evenly and to provide some degree of torque slippage to minimize damage of the fuse element portion 108 during the bolt down installation.

Further, as the fuse 200 is uninstalled, any torque forces associated with the loosening of the bolts 120, 122 in an opposite direction to arrow F may also be restricted. That is, the terminal elements 204, 206 may also rotate in the opposite direction when the bolts 120, 122 are loosened as when they are tightened, and similarly operate to mechanically isolate the fuse element portion 108 from torsional force.

The benefits of the exemplary concepts disclosed are now believed to be apparent from the exemplary embodiments disclosed.

An embodiment of an electrical fuse has been disclosed comprising: a housing; a fuse element within the housing and having an end; and a terminal element coupled to the fuse element at the end, the terminal element projecting from the housing and configured to be fastened to a circuit conductor; wherein the terminal element is rotatable relative to the end of the fuse element.

Optional features, in combination with the embodiment above include: the end of the fuse element is substantially planar; the terminal element defines a sleeve fitted over the end of the fuse element; the housing defines a clearance, the terminal element rotatable in the clearance; the housing is generally rectangular; the housing comprises a base and a substantially rectangular cover; the base comprises a substantially planar bottom wall, and at least one wall projecting upwardly from the bottom wall, the fuse element extending over the at least one wall; and the cover includes at least one wall formed with an opening therein, and the at least one wall of the base receivable in the opening.

As further optional features, in combination with the embodiment above: the housing comprises opposing top and bottom walls and an end wall interconnecting the top and bottom wall, wherein the terminal element projects from the end wall of the housing at a location spaced from the top wall and the bottom wall; the terminal element comprises at least one notch, and the housing defines a clearance adjacent the at least on notch, wherein the at least one notch is rotatable within the clearance; the end of the fuse element includes a first opening and the terminal element includes a second opening, wherein the first and second openings substantially coincide; and at least one of the first and second openings is a circular opening.

Still further optional features include, in combination with the embodiment above: the fuse element comprises an elongated conductor having a plurality of openings formed therein; wherein the elongated conductor is fabricated from a substantially planar conductive body; wherein the elongated conductor is formed with a first side edge extending substantially perpendicular to the body in a first direction; wherein the elongated conductor is further formed with a second side edge extending substantially perpendicular to the body in a second direction, wherein the second direction is opposite to the first direction; and wherein the terminal element is configured to be fastened to the circuit conductor with a bolt.

Another embodiment of an electrical fuse has also been disclosed comprising: a housing; a fuse element within the housing and having opposing first and second ends; and a first and second terminal element coupled to the fuse element at the respective first and second ends, the first and second terminal element projecting from the housing and each having freedom to move relative to the respective first and second end and also the housing, thereby restricting a transmission of an applied torque on the first or second terminal element to the first or second end of the fuse element.

Optional features, in combination with the embodiment above include: wherein the first and second terminal elements are sleeves fitted over the respective first and second ends; wherein the first and second terminal elements each include a pair of notches, and wherein the housing defines a clearance adjacent the respective notches of the first and second terminal elements; wherein the housing comprises a base and a substantially rectangular cover; wherein the base comprises a substantially planar bottom wall, and spaced apart end walls projecting upwardly from the bottom wall, the fuse element extending over the spaced apart end walls and the first and second ends of the fuse element projecting beyond the respective spaced apart end walls; wherein the cover includes opposite end walls having openings therein, and the end walls of the base receivable in the openings of the end walls of the cover; and wherein the housing is substantially rectangular and includes opposing top and bottom walls and opposing end walls interconnecting the top and bottom walls, wherein each the first and second terminal elements project from one of the end walls at a location spaced from the top wall and the bottom wall.

As further optional features, in combination with the embodiment above: each first and second ends of the fuse element include a first opening, wherein the first and second terminal elements each include a second opening, and wherein the first and second openings substantially coincide; the first and second openings are concentric circular openings; the fuse element comprises an elongated conductor having a plurality of openings formed therein; the elongated conductor is fabricated from a substantially planar conductive body; the elongated conductor further is formed with a first side edge extending substantially perpendicular to the body in a first direction; the elongated conductor is further formed with a second side edge extending substantially perpendicular to the body in a second direction, wherein the second direction is opposite to the first direction; the first and second terminal elements are each configured to be clamped to a circuit conductor with a bolt.

Another embodiment of an electrical fuse has been disclosed comprising: a substantially rectangular housing comprising a top wall, a bottom wall, opposing side walls, and opposing end walls; a fuse element within the housing and having opposing first and second ends; and a first and second terminal element coupled to the fuse element at the respective first and second ends, the first and second terminal element projecting from the respective one of the end walls of the housing and each having a degree of freedom to move relative to the respective first and second end and also the respective end wall of the housing, thereby restricting a transmission of an applied torque on the first or second terminal element to the first or second end of the fuse element.

Optional features, in combination with the embodiment above include: wherein the first and second terminal elements are sleeves fitted over the terminal end; wherein the first and second terminal elements each include a pair of notches, and wherein each end wall of the housing defines a clearance adjacent the respective notches of the first and second terminal elements; wherein each of the first and second terminal elements project from one of the end walls at a location spaced from the top wall and the bottom wall; wherein each first and second ends of the fuse element include a first opening, wherein the first and second terminal elements each include a second opening, and wherein the first and second openings substantially coincide; and wherein the first and second terminal elements are each configured to be clamped to a conductor with a bolt.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An electrical fuse configured to be fastened to a circuit conductor with a bolt, the electrical fuse comprising:

a housing;

a fuse element secured within the housing and having an end provided with a first through hole; and a terminal element coupled to the fuse element at the end, the terminal element projecting from the housing and provided with a second through hole;

wherein the first through hole and the second through hole are aligned with one another; and wherein the terminal element is rotatable relative to the end of the fuse element when the bolt is extended through the aligned first and second through holes, thereby mechanically isolating the end of the fuse element from torque applied to the bolt to fasten the fuse to the circuit conductor.

2. The electrical fuse of claim 1, wherein the end of the fuse element is substantially planar.

3. The electrical fuse of claim 1, wherein the terminal element defines a sleeve fitted over the end of the fuse element.

4. The electrical fuse of claim 1, wherein the housing defines a clearance, the terminal element rotatable in the clearance to maintain the mechanical isolation when subjected to a predetermined amount of torque via the bolt.

5. The electrical fuse of claim 1, wherein the housing is generally rectangular.

6. The electrical fuse of claim 1, wherein the housing comprises a base and a substantially rectangular cover.

7. The electrical fuse of claim 6, wherein the base comprises a substantially planar bottom wall, and at least one wall projecting upwardly from the bottom wall, the fuse element extending over the at least one wall.

8. The electrical fuse of claim 7, wherein the cover includes at least one wall formed with an opening therein, and the at least one wall of the base receivable in the opening.

9. The electrical fuse of claim 1, wherein the housing comprises opposing top and bottom walls and an end wall interconnecting the top and bottom wall, wherein the terminal element projects from the end wall of the housing at a location spaced from the top wall and the bottom wall.

10. The electrical fuse of claim 1, wherein the terminal element comprises at least one notch, and the housing defines a clearance adjacent the at least one notch, wherein the at least one notch is rotatable within the clearance.

11. The electrical fuse of claim 1, wherein at least one of the first and second through holes is circular.

12. The electrical fuse of claim 1, wherein the fuse element comprises an elongated conductor having a plurality of openings formed therein.

13. The electrical fuse of claim 12, wherein the elongated conductor is fabricated from a substantially planar conductive body.

14. The electrical fuse of claim 13, wherein the elongated conductor is formed with a first side edge extending substantially perpendicular to the body in a first direction.

15. The electrical fuse of claim 14, wherein the elongated conductor is further formed with a second side edge extending substantially perpendicular to the body in a second direction, wherein the second direction is opposite to the first direction.

16. An electrical fuse comprising:

a housing;

a fuse element within the housing and having opposing first and second ends; and a first and second terminal element coupled to the fuse element at the respective first and second ends, the first and second terminal element projecting from the housing and each having freedom to move relative to the respective first and second ends and also freedom to move relative to the housing when the fuse element is secured within the housing;

wherein when the first and second terminal elements are subjected to an applied torque to fasten the fuse to a circuit conductor, the first and second terminal elements are movable and thereby restrict a transmission of the applied torque on the first or second terminal element to the first or second ends of the fuse element; and wherein the first and second terminal elements each include a pair of notches, and wherein the housing defines a clearance adjacent the respective notches of the first and second terminal elements.

17. The electrical fuse of claim 16, wherein the first and second terminal elements are sleeves fitted over the respective first and second ends.

18. The electrical fuse of claim 16, wherein the housing comprises a base and a substantially rectangular cover.

19. The electrical fuse of claim 18, wherein the base comprises a substantially planar bottom wall, and spaced apart end walls projecting upwardly from the bottom wall, the fuse element extending over the spaced apart end walls and the first and second ends of the fuse element projecting beyond the respective spaced apart end walls.

20. The electrical fuse of claim 19, wherein the cover includes opposite end walls having openings therein, and the end walls of the base are receivable in the openings of the end walls of the cover.

21. The electrical fuse of claim 16, wherein the housing is substantially rectangular and includes opposing top and bottom walls and opposing end walls interconnecting the top and bottom walls, wherein each the first and second terminal elements project from one of the end walls at a location spaced from the top wall and the bottom wall.

22. The electrical fuse of claim 16, wherein each first and second ends of the fuse element include a first opening, wherein the first and second terminal elements each include a second opening, and wherein the first and second openings substantially coincide.

23. The electrical fuse of claim 22, wherein the first and second openings are concentric circular openings.

24. The electrical fuse of claim 16, wherein the fuse element comprises an elongated conductor having a plurality of openings formed therein.

25. The electrical fuse of claim 24, wherein the elongated conductor is fabricated from a substantially planar conductive body.

26. The electrical fuse of claim 25, wherein the elongated conductor further is formed with a first side edge extending substantially perpendicular to the body in a first direction.

27. The electrical fuse of claim 26, wherein the elongated conductor is further formed with a second side edge extending substantially perpendicular to the body in a second direction, wherein the second direction is opposite to the first direction.

28. The electrical fuse of claim 22, wherein the first and second openings are configured to receive a shank of a bolt when the first and second terminal element are fastened to the circuit conductor.

29. An electrical fuse comprising:

a substantially rectangular housing comprising a top wall, a bottom wall, opposing side walls, and opposing end walls;

a fuse element secured within the housing and having opposing first and second ends, each of the opposing first and second ends provided with a first through hole configured to be fastened to a circuit conductor; and a first and second terminal element coupled to the fuse element at the respective first and second ends, each of the first and second terminal elements provided with a second through hole and a pair of notches;

wherein each end wall of the housing defines a clearance adjacent the respective notches of the first and second terminal elements and wherein the first through hole of each of the first and second ends of the fuse element is aligned with the second through hole of each of the first and second terminal element; and wherein each of the first and second terminal element respectively projects from one of the opposing end walls of the housing and has a degree of freedom to move within the clearance relative to each end wall of the housing and the respective first and second end of the fuse element, thereby restricting a transmission of an applied torque on the first or second terminal element to the first or second ends of the fuse element when a fastener is extended through the aligned first and second through holes and the fuse element is fastened to the circuit conductor.

30. The electrical fuse of claim 29, wherein the first and second terminal elements are sleeves fitted over the respective first and second ends of the fuse element.

31. The electrical fuse of claim 29, wherein each of the first and second terminal elements project from one of the end walls at a location spaced from the top wall and the bottom wall.

32. The electrical fuse of claim 29, wherein the fastener is a bolt.

33. The electrical fuse of claim 29, wherein the housing comprises a base and cover attachable to the base.

34. The electrical fuse of claim 29, wherein at least one of the first through holes of each of the first and second ends of the fuse element and the second through holes of each of the first and second terminal element is a circular opening.

35. The electrical fuse of claim 29, wherein the fuse element is substantially planar.

* * * * *